US006035539A

United States Patent [19]

Hollenbach et al.

[11] Patent Number: 6,035,539

[45] Date of Patent: Mar. 14, 2000

[54] FIBEROPTIC GUN SIGHT

[75] Inventors: Ned J. Hollenbach, Murfreesboro, Ark.; Randall D. Jernigan, Suwanee; Dean N. Williams, Griffin, both of Ga.

[73] Assignee: Connecticut Valley Arms, Inc., Norcross, Ga.

[21] Appl. No.: 08/798,073

[22] Filed: Feb. 12, 1997

[51] Int. Cl.[7] ..... F41G 1/32

[52] U.S. Cl. ..... 33/241; 42/100; 42/103; 33/244

[58] Field of Search ..... 33/241, 251, 261, 33/244; 42/100, 102, 1; 350/10

[56] References Cited

U.S. PATENT DOCUMENTS

| | | | |
|---|---|---|---|
| Re. 24,313 | 5/1957 | Munsey . | |
| 875,016 | 12/1907 | Uren et al. | 42/100 |
| 2,911,724 | 11/1959 | Conant . | |
| 3,098,303 | 7/1963 | Pilsk . | |
| 3,439,970 | 4/1969 | Rickert . | |
| 3,641,676 | 2/1972 | Knutsen et al. | 33/52 |
| 3,820,248 | 6/1974 | Hayward | 33/241 |
| 3,834,035 | 9/1974 | Merrill | 33/251 |
| 3,914,873 | 10/1975 | Elliott, Jr. et al. | 33/241 |
| 3,945,142 | 3/1976 | Keppeler | 42/1 |
| 4,030,203 | 6/1977 | Ackerman, Jr. . | |
| 4,400,887 | 8/1983 | Mason . | |
| 4,434,560 | 3/1984 | Comeyne | 33/241 |
| 4,627,171 | 12/1986 | Dudney . | |
| 4,745,698 | 5/1988 | Schwulst . | |
| 4,806,007 | 2/1989 | Bindon . | |
| 4,877,316 | 10/1989 | Edwards et al. . | |
| 4,928,394 | 5/1990 | Sherman . | |
| 4,936,190 | 6/1990 | Pilcher, II . | |
| 4,953,302 | 9/1990 | Gould . | |
| 5,052,790 | 10/1991 | Edwards et al. . | |
| 5,080,084 | 1/1992 | Kendall et al. . | |
| 5,090,805 | 2/1992 | Stawarz . | |
| 5,094,002 | 3/1992 | Saunders . | |
| 5,121,462 | 6/1992 | Fabre et al. . | |
| 5,122,932 | 6/1992 | Ziller . | |
| 5,148,603 | 9/1992 | Beutler . | |
| 5,157,839 | 10/1992 | Beutler . | |
| 5,168,540 | 12/1992 | Winn et al. . | |
| 5,181,718 | 1/1993 | Valentine . | |
| 5,201,124 | 4/1993 | Sherman . | |
| 5,231,765 | 8/1993 | Sherman . | |
| 5,322,049 | 6/1994 | Dunlap . | |
| 5,435,068 | 7/1995 | Thames et al. . | |
| 5,442,861 | 8/1995 | Lorocco . | |
| 5,638,604 | 6/1997 | Lorocco | 33/241 |
| 5,735,070 | 4/1998 | Vasquez et al. | 42/102 |

FOREIGN PATENT DOCUMENTS

| | | | |
|---|---|---|---|
| 4214997A1 | 11/1993 | Germany | 33/241 |

*Primary Examiner*—Charles T. Jordan
*Assistant Examiner*—Denise J. Buckley
*Attorney, Agent, or Firm*—Pepe & Hazard LLP

[57] ABSTRACT

A naturally illuminated three dot sighting system for firearms includes a rear sight having two dots formed by scintillating fibers encased in an optically clear polymer block, and a front sight having one dot formed by a scintillating fiber within an optically clear polymer post. The rear sight has a center channel with scintillating fibers disposed on each side thereof. In poor ambient light, the light incident on the optically clear blocks travels to the fibers which gather such light and scintillate to provide dots of light at their proximal ends which can be aligned.

20 Claims, 3 Drawing Sheets

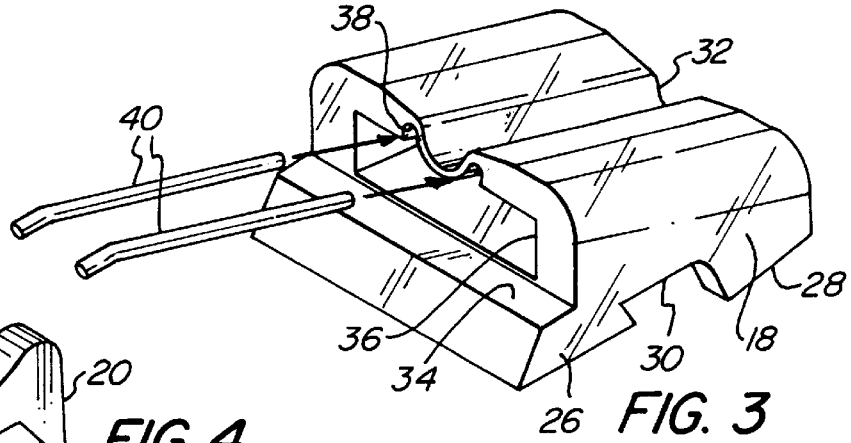
FIG. 3
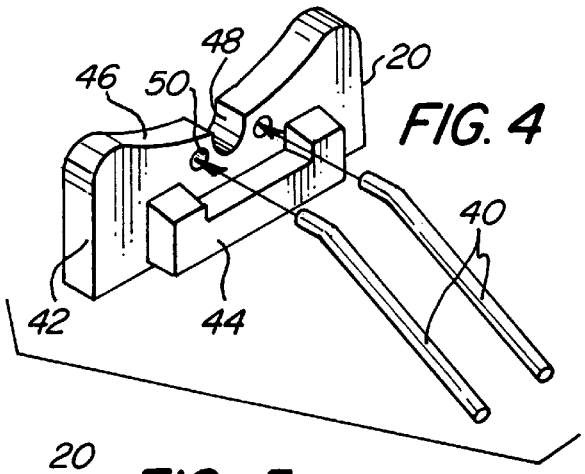
FIG. 4
FIG. 5
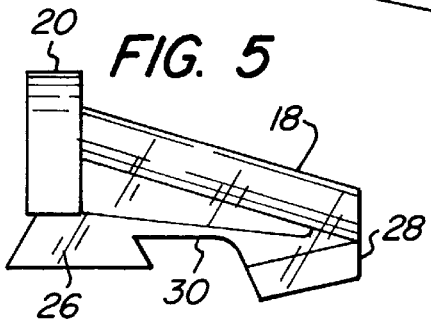
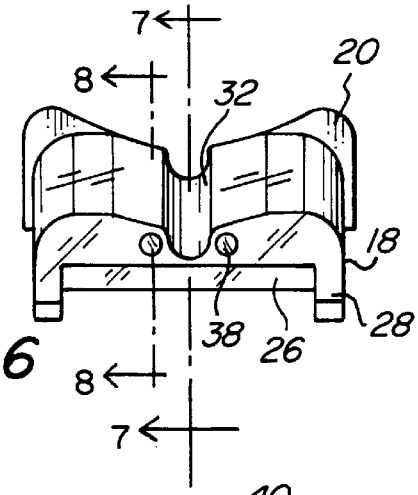
FIG. 6
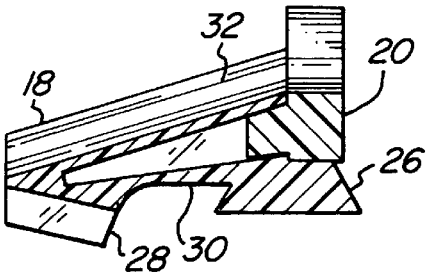
FIG. 7
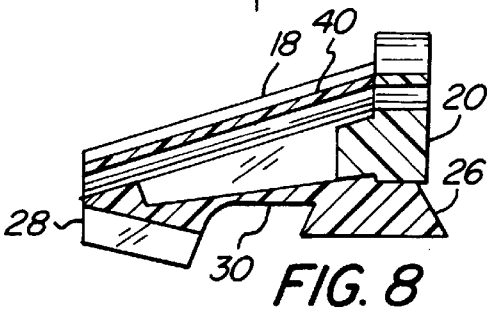
FIG. 8
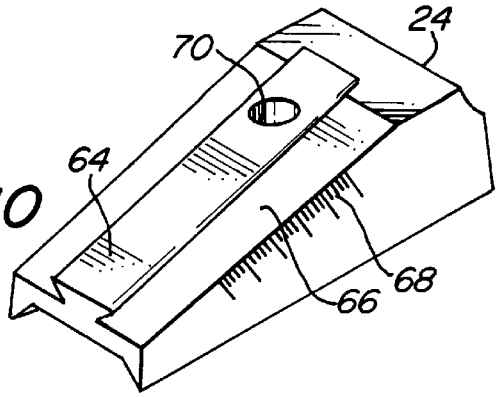
FIG. 10
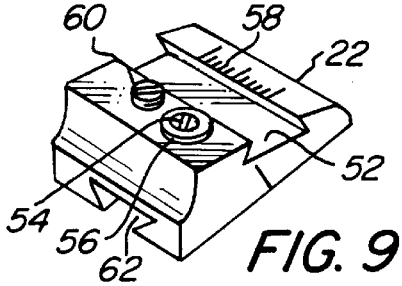
FIG. 9

FIBEROPTIC GUN SIGHT

BACKGROUND OF THE INVENTION

The present invention relates to a sights for firearms, and, more particularly, to an illuminated sight assembly utilizing ambient light.

Several varieties of sights are employed in the sports of hunting and target shooting to improve aim under various shooting conditions. Traditional firearm sights have been formed from metal beads, bars or notches, or from a combination thereof, disposed at the front and rear ends of the barrel and these are aligned with the target. The most common sight assembly employs a rear sight with a V-notch and a front sight with a post which is aligned in the notch. Some sighting mechanisms include an adjustable rear sight, some use telescopes, and some use artificial lighting.

It is also known to employ a single fluorescent fiber in combination with a clear plastic resin, such as an acrylic, in a firearm sight. This type of sight is disclosed in U.S. Pat. No. 3,098,303 which issued to Plisk on Jul. 23, 1963. Similar types of sights also have been designed for archery applications, such as that shown in U.S. Pat. No. 5,442,861 which issued to Lorocco on Aug. 22, 1995. It is also known to use artificial light sources in combination with fluorescent fibers to enable sighting under conditions of low light levels, such as dusk or dawn.

Accordingly, it is an object of the present invention to provide a novel sight assembly for firearms which is effective in low ambient light conditions to facilitate sight alignment.

It is also an object to provide such a sight assembly which utilizes light gathering or scintillating fibers in an illuminated sighting system operable by ambient light.

Another object is to provide such a sight assembly which can be fabricated relatively easily and which provides a rugged assembly.

Still another object is to provide such a sight assembly with low optical distortion.

Still another object is to provide a novel three dot assembly which enables horizontal and vertical adjustment to compensate for wind and distance.

SUMMARY OF THE INVENTION

It has now been found that the foregoing and related objects may be readily attained in a three dot fiber optic sighting system for firearms, which includes a rear sight block for mounting on the rear portion of a firearm barrel. The block has an upper surface with a central channel and has passages therein on opposite sides of and adjacent said channel, all extending longitudinally thereof. The sight block is formed of an optically clear material and has scintillating fibers in the passages with their proximal ends visible to a shooter. A front sight for mounting on the front portion of the firearm barrel has at least one upstanding post for alignment with the rear sight channel between the rear sight scintillating fibers. The post is formed of an optically clear material and has a passage therein in which is disposed a scintillating fiber having a proximal end visible to the shooter. As a result, the three fibers may be aligned to align the firearm with a target.

Preferably, the rear sight provides an opaque rear surface about the fibers which extend parallel to the channel. The scintillating fibers are elongated and react to light impinging thereon and passing through the optically clear material of the sight block. Desirably, the front sight has a pair of longitudinally spaced posts and the scintillating fiber extends therethrough and therebetween.

The optically clear material is preferably a polycarbonate resin, and the scintillating fibers have a polystyrene core doped with a fluorescent dopant and have a polymethyl methacrylate cladding.

The opaque rear surface of the rear sight is provided by an opaque cap secured to the rear surface of the block and it has passages therein aligned with the adjacent ends of said passages in the block and into which the scintillating fibers extend. Preferably, the rear sight cap is made of opaque resin and the axes of the rear sight cap passages are parallel to the barrel of the firearm. The passages in the block are angled downwardly from the juncture of the cap and the block.

In a preferred embodiment, the rear sight block is mounted on a support adapted to be secured to the barrel of the firearm, and the support provides adjustment of the block transversely and longitudinally of the barrel. Desirably, the rear sight block has a transversely extending wedge-shaped projection on its lower surface and the support includes an intermediate support member with a wedge-shaped channel extending transversely of a groove in its upper surface slidably seating the projection. The support includes a base member adapted to be secured to the barrel and having a wedge-shaped projection on its upper surface which is inclined longitudinally and the intermediate support member has a wedge-shaped channel extending longitudinally of its lower surface and it slidably seats the projection.

Preferably, the top surface of the rear sight block slopes downwardly from its proximal end.

Desirably, the front sight block is mounted on a support adapted to be secured to the barrel of the firearm. To do so, the front sight block has a wedge-shaped projection extending transversely on its bottom surface, and the support is an elongated member having a transversely extending wedge-shaped channel on its upper surface in which the projection is seated.

BRIEF DESCRIPTION OF THE DRAWINGS

FIG. 3 is a rear perspective view of the sight block in the rear sight with the fibers prior to insertion thereinto;

FIG. 4 is a front perspective view of the rear sight cap with the fibers oriented for their ends to seat therein;

FIG. 5 is a side elevational view of the subassembly of the cap and block;

FIG. 6 is a front perspective view of the subassembly of FIG. 5;

FIG. 7 is a sectional view of the subassembly along the line 7—7 of FIG. 6;

FIG. 8 is a sectional view of the subassembly along the line 8—8 of FIG. 6 showing the scintillating fiber;

FIG. 9 is a rear perspective view of the rear sight intermediate support;

FIG. 10 is a rear perspective view of the rear sight base support;

DETAILED DESCRIPTION OF THE PREFERRED EMBODIMENT

Figure 1:
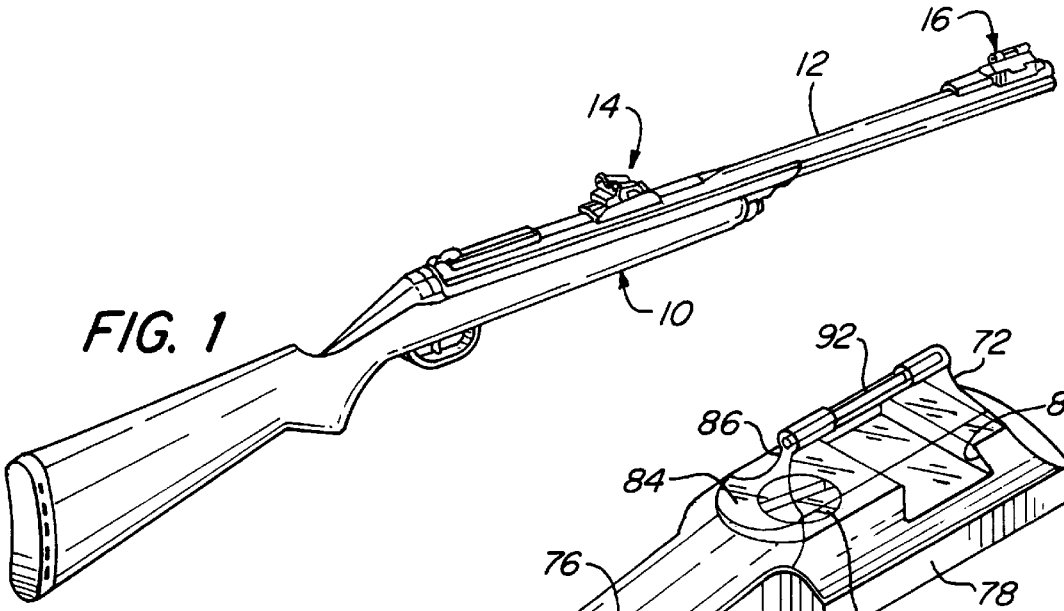
FIG. 1 is a perspective view of a firearm employing the novel sight assembly of the present invention.

Turning first to FIG. 1, therein generally illustrated is a three dot illuminated sight assembly embodying the present invention as mounted on a firearm generally designated by the numeral 10 and having a barrel 12. Adjacent the breech end of the barrel is the rear sight generally designated by the numeral 14 and adjacent the muzzle end is mounted the front sight generally designated by the numeral 16.

Figure 2:
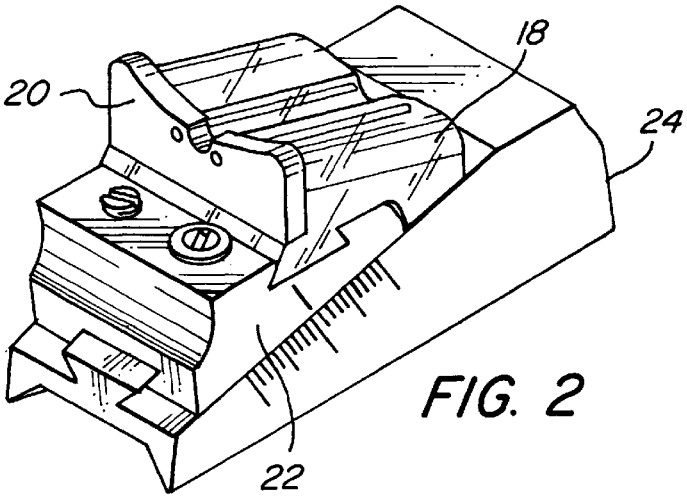
FIG. 2 is a perspective view drawn to an enlarged scale of the rear sight of the sight assembly.

Turning first in detail to the rear sight 14 as seen in FIG. 2, it is comprised of the block 18 with a cap 20 extending across the rear surface thereof. The block 18 is adjustably mounted on the barrel 12 by the intermediate support 22 and base support 24.

As seen in FIGS. 3 and 5–8, the block 18 is formed of a clear synthetic resin with a generally rectangular foot print. Its bottom surface includes a transversely extending wedge-shaped portion 26 at its rearward end and an inclined inverted U-shaped portion 28 at its forward end with a transverse channel 30 therebetween.

The upper surface is inclined downwardly from its rearward end and has a generally arcuate channel or groove 32 extending longitudinally thereof. The rearward surface includes a step providing a shoulder 34, and a recess 36 extending forwardly therefrom. On either side of the channel 32 is a circular passage 38 extending at a downward angle parallel to the channel 32 from the rear of the front surface of the block 18. Seated in the circular passages 38 are scintillating fibers 40 to be described more fully hereinafter.

The rear cap 20 has a body portion 42 which seats on the shoulder 34 and a U-shaped mounting portion 44 on the front surface thereof which seats in the recess 36. The upper surface 46 of the body portion 42 is generally concavely arcuate with an arcuate channel or groove 48 centrally thereof which is aligned with the channel 32 in the block 18. Cavities or bores 50 extend through the body portion 42 on either side of the channel 48 above the mounting portion 44 and seat the ends of the scintillating fibers 40.

The cap 20 and block 18 are bonded by adhesive on their mating surfaces to provide a secure subassembly. This subassembly is mounted on the intermediate support 22 and base support 24 so as to be adjustably positioned on the barrel 12 in accordance with conventional construction.

The intermediate support 22 and base support 24 are shown in FIGS. 9 and 10, respectively, and are commonly available components of rear sights. The rear sight block 18 has been configured for use therewith. This support assembly enables horizontal adjustment and vertical adjustment to compensate for windage and distance. The components are conventionally formed of metal and the intermediate support 22 has a wedge-shaped transversely extending groove 52 on its upper surface which seats the wedge-shaped portion 26 of the sight block 18 so that it may be adjusted transversely on the barrel 12. The adjusting screw 54 and washer 56 are threadably seated in the intermediate support 22 to secure the block 18 in an adjusted position and graduations 58 are provided on the upper surface to facilitate positioning.

A second adjusting screw 60 is also provided to engage the base support 24. The intermediate support 22 has a wedge-shaped channel 62 extending longitudinally in its lower surface and this seats the wedge-shaped rib 64 on the upper surface of the base support 24. This allows the intermediate support 22 to move longitudinally of the barrel 12, and, when the screw 60 is tightened, the intermediate support 22 is locked in place.

As seen in FIG. 10, the base support 24 has an inclined upper surface portion 66 which permits a vertical adjustment in the position of the sight block 18 to accommodate distance. Graduations 68 are provided along the side of the base support 24 to facilitate positioning, and a mounting screw (not shown) extends through the aperture 70 to engage the barrel 12 and mount the entire rear sight thereon.

Figure 11:
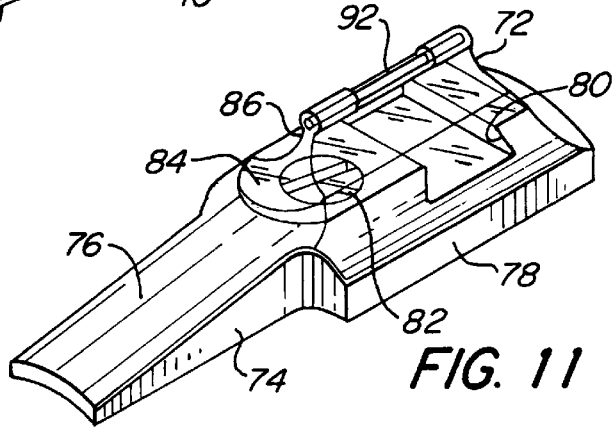
FIG. 11 is a rear perspective view of the front sight drawn to an enlarged scale.
Figure 12:
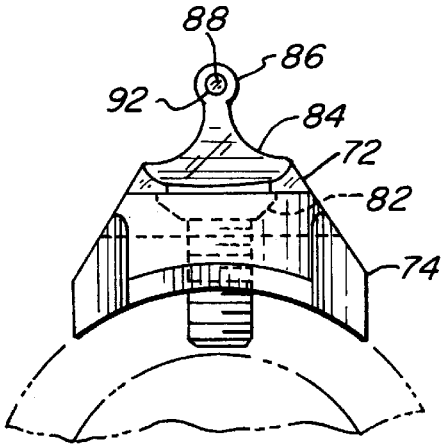
FIG. 12 is a front elevational view of the front sight drawn to an enlarged scale as mounted on a barrel with the barrel and mounting screw shown in phantom line.
Figure 13:
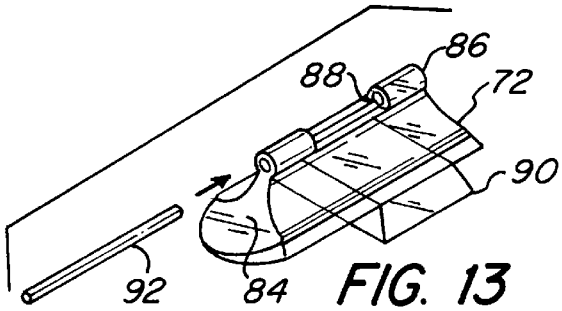
FIG. 13 is a rear perspective view of the front sight block with the scintillating fiber prior to insertion thereinto.
Figure 14:
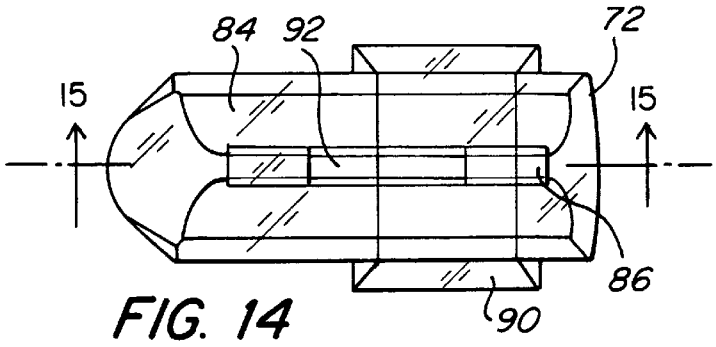
FIG. 14 is a top plan view of the front sight block drawn to an enlarged scale.
Figure 16:
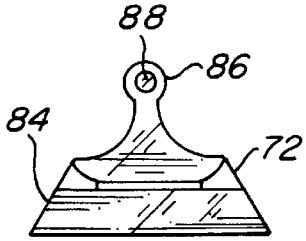
FIG. 16 is a front elevational view of the front sight block.
Figure 15:
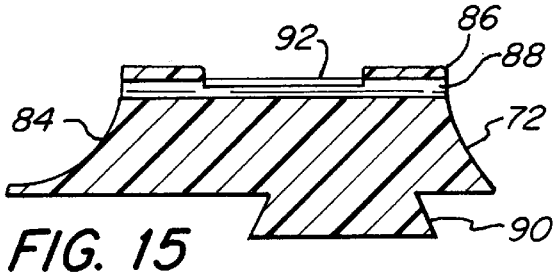
FIG. 15 is a sectional view of the front sight block along the line 15—15 of FIG. 14.
Figure 17:
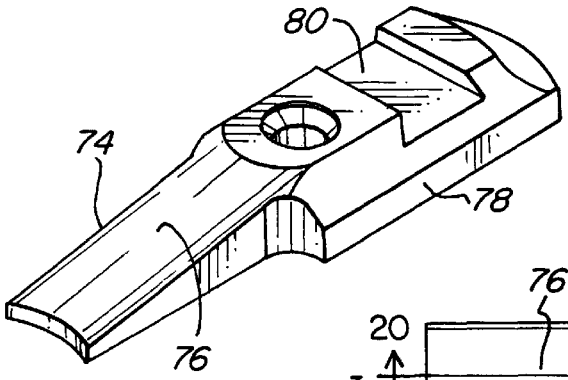
FIG. 17 is a rear perspective view of the front sight base drawn to an enlarged scale.
Figure 18:
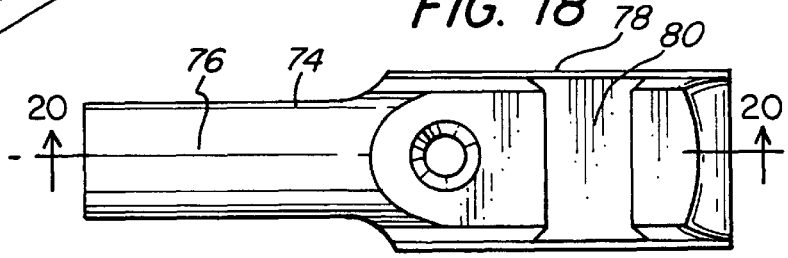
FIG. 18 is a top plan view of the front sight base.
Figure 19:
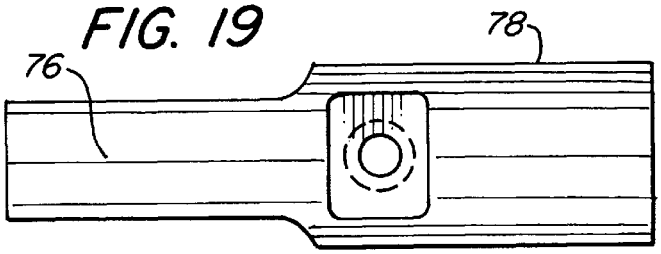
FIG. 19 is a bottom view of the front sight base.

Turning next in detail to the front sight 16, as seen in FIGS. 11 and 12, it is comprised of a block 72 and a base 74. The base 74 is elongated with a downwardly and rearwardly inclined rear portion 76 and a body portion 78 with a transversely extending wedge-shaped channel 80 in its upper surface. A mounting screw 82 extends through the body portion 78 to secure the front sight assembly to the barrel 12 as seen in FIG. 12.

The block 72 has an elongated body portion 84 with concavely arcuate side and end surfaces, and two longitudinally spaced, generally cylindrical posts 86 are formed thereon. Aligned passages 88 extend through the posts 86. The bottom surface of the block 72 has a wedge-shaped portion 90 which seats in the channel 80 of the base 74. The two components 72, 74 are secured in assembly by an adhesive. Extending through the passages 88 in the posts 86 and therebetween is a scintillating fiber 92.

Figure 21:
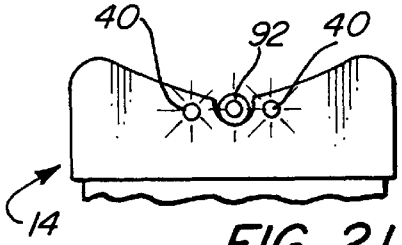
FIG. 21 is a partially diagrammatic view of the aligned sights as viewed by the shooter.
Figure 20:
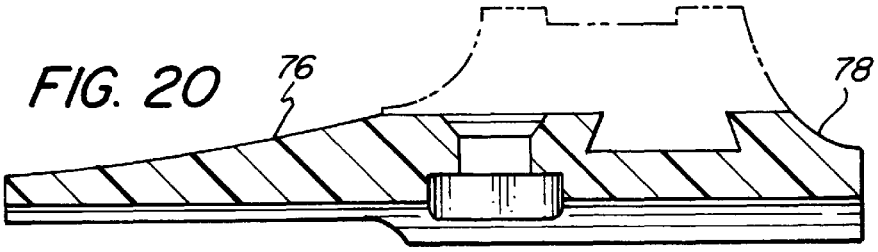
FIG. 20 is a sectional view of the front sight base along the line 20—20 of FIG. 18 and drawn to an enlarged scale.

Thus, in sighting the firearm in daylight, the shooter aligns the posts 86 in the channel 32 of the rear sight 14 in accordance with conventional practice. In reduced ambient light, the shooter is able to align the dot of light provided by the scintillating fiber 90 in the front sight 16 between the pair of dots of light provided by the scintillating fibers 40 in the rear sight 14, as diagrammatically illustrated in FIG. 21.

It can be readily seen that the illuminated three dot sighting system described above enables improved aiming of a firearm, particularly under poor ambient lighting conditions. The rear sight is designed to maximize the amount of light provided to the ends of the two scintillating fibers which provide the two rear sighting dots, and to minimize the sources of possible distortion in aiming. The optically clear plastic block 18 transmits light incident thereon to the scintillating fibers 40, which thus gather maximum light under low light conditions. The disposition of the fibers maximizes light absorption in that the fibers run the length of the rear sight block and collect light incident thereon about 360 degrees. In addition, the fibers 40 are protected from impact and the weather by virtue of being encased in the polymer block 18.

The fibers 40 thus gather and provide maximum light at their proximal ends encased in the opaque rear sight cap 20, which is preferably fabricated from a black polycarbonate resin. The rear sight cap 20 is opaque to accentuate the sighting dots and to avoid distortion caused by the visibility of other components. Distortion is also minimized by the downward slope of the rear sight block 18 which prevents the shooter from seeing its extensive surface while shooting.

The front sight assembly 10 is similarly designed to provide comparable optics by formation of the block 72 of an optically clear resin such as polycarbonate which will transmit incident light to the fiber 92 which is also directly receiving light incident upon its exposed surface between the posts 86.

The synthetic resin parts may be conveniently fabricated by injection molding in the desired configuration and/or by machining blocks of the resin. The preferred optically clear polymer is polycarbonate resin because of its impact resistance, but methyl methylate resins may also be employed.

The cavities or passages for the fibers may be provided by steel rods inserted in a mold cavity during a molding process or by drilling either mechanically or by laser beam.

The scintillating fibers used in the present invention exhibit the property of transforming light of one wavelength into light of a different, usually higher, wavelength which is emitted at the ends of the fiber. As is described in the literature, the wavelength of light which they will produce depends upon the dopant applied to the core. The general nature of such articles is described in Winn et al. U.S. Pat. No. 5,168,540 granted Dec. 1, 1992. Typically, such fibers have a polystyrene core containing the dopant and a polymethyl methacrylate cladding.

Preferably, the scintillating fibers have a diameter of 0.040 inches, a length of 0.625 inches, and consist of a core of polystyrene having a refractive index of approximately 1.60 and containing fluorescent dopants selected to produce a desired color. This core is clad with a layer of polymethyl methacrylate with a refractive index of approximately 1.49 and having a thickness of about 3 percent of total thickness, in the case of a round fiber, or about 4 percent of total width, in the case of a square fiber. A product having these desired characteristics is sold under the trademark "OPTIBRIGHT" by Poly-optical Products, Inc. in Irvine, Calif.

Thus, it can be seen from the foregoing detailed description and attached drawings that the sighting assembly of the present invention provides enhanced sighting capability under conditions of reduced ambient light by concentrating and converting incident light in scintillating fibers which will provide alignable dots of light. The assembly can be fabricated relatively easily and is rugged and easy to use.

Having thus described the invention, what is claimed is:

1. A three dot fiber optic sighting system for firearms, comprising:

(a) an elongated rear sight block for mounting on the rear portion of a firearm barrel and having an upper surface with a central channel and having elongated passages therein on opposite sides of and adjacent said channel, said channel and passages all extending longitudinally thereof, said rear sight block being formed of an optically clear material and having an opaque rear surface, said rear sight block having elongated scintillating fibers extending in said passages with their proximal ends visible at said rear surface to a shooter, said rear sight block passages extending parallel to said channel, said scintillating fibers being elongated and reacting to light impinging thereon and passing through said optically clear material of said sight block; and (b) a front sight block for mounting on the front portion of a firearm barrel, said front sight block having at least one upstanding post for alignment with said rear sight block channel between said rear sight scintillating fibers, said post being formed of an optically clear material and having a passage therein in which is disposed an elongated scintillating fiber having a proximal end visible to the shooter, whereby the three fibers may be aligned to align the firearm with a target.

2. The three dot fiber optic sighting system for firearms in accordance with claim 1 wherein said front sight block has a pair of longitudinally spaced posts and said scintillating fiber extends therethrough and therebetween.

3. The three dot fiber optic sighting system for firearms in accordance with claim 1 wherein said optically clear material is a polycarbonate resin.

4. The three dot fiber optic sighting system for firearms in accordance with claim 1 wherein said scintillating fibers have a polystyrene core doped with a fluorescent dopant and polymethyl methacrylate cladding.

5. The three dot fiber optic sighting system for firearms in accordance with claim 2 wherein said opaque rear surface of said rear sight block is provided by an opaque cap secured to the rear surface of said block and having passages therein aligned with the adjacent ends of said passages in said block and into which said scintillating fibers extend.

6. The three dot fiber optic sighting system for firearms in accordance with claim 5 wherein said rear sight block cap is made of an opaque resin and wherein the axes of said rear sight block cap passages are parallel to the barrel of the firearm and wherein said passages in said block are angled downwardly from the juncture of said cap and said block.

7. The three dot fiber optic sighting system for firearms in accordance with of claim 1 wherein said rear sight block is mounted on a support adapted to be secured to the barrel of said firearm.

8. The three dot fiber optic sighting system for firearms in accordance with claim 7 wherein said rear support sight provides adjustment of said block transversely and longitudinally of the barrel.

9. The three dot fiber optic sighting system for firearms in accordance with claim 7 wherein said rear sight block has a transversely extending wedge-shaped projection on its lower surface and said support includes an intermediate support member with a wedge-shaped channel extending transversely of its upper surface and in which is slidably seated said projection of said rear sight block.

10. The three dot fiber optic sighting system for firearms in accordance with claim 9 wherein said support includes a base member adapted to be secured to the barrel and having a wedge-shaped projection on its upper surface which is inclined longitudinally and wherein said intermediate support member has a wedge-shaped channel extending longitudinally of its lower surface and slidably seating said projection.

11. The three dot fiber optic sighting system for firearms in accordance with claim 1 wherein the top surface of said rear sight block slopes downwardly from its proximal end.

12. The three dot fiber optic sighting system for firearms in accordance with claim 1 wherein said front sight block is mounted on a support adapted to be secured to the barrel of the firearm.

13. The three dot fiber optic sighting system for firearms in accordance with claim 12 wherein said front sight block has a wedge-shaped projection extending transversely thereof on its bottom surface, and said support is an elongated member having a transversely extending wedge-shaped channel on its upper surface in which said projection is seated.

14. A fiberoptic sighting system for firearms comprising:

(a) an elongated rear sight block for mounting on the rear portion of a firearm barrel and having an upper surface sloping downwardly from adjacent its proximal end, said upper surface having a central channel extending along its upper surface and having elongated passages therein on opposite sides of and adjacent said channel, said channel and passages all extending longitudinally thereof, said rear sight block being formed of an optically clear material, said sight block having scintillating fibers in said passages with their proximal ends visible at the rear surface of said block to a shooter, said rear sight block having an opaque rear surface about said fibers, said rear sight block passages extending parallel to said channel, and said scintillating fibers being elongated and reacting to light impinging thereon and passing through said optically clear material of said sight block, said optically clear material being a polycarbonate resin; and (b) a front sight block for mounting on the front portion of the firearm barrel, said front sight block having at least one upstanding post for alignment with said rear sight block channel between said rear sight scintillating fibers.

15. A fiberoptic sighting system for firearms in accordance with claim 14 wherein said front sight has a pair of longitudinally spaced posts and a scintillating fiber extends therethrough and therebetween.

16. A fiberoptic sighting system for firearms in accordance with claim 15 wherein said scintillating fibers have a polystyrene core doped with a fluorescent dopant and a polymethyl methacrylate cladding.

17. A fiberoptic sighting system for firearms in accordance with claim 15 wherein said opaque surface of said rear sight block is provided by a cap secured to the rear surface of said block and said cap has passages therein aligned with the adjacent ends of said passages in said block and into which said scintillating fibers extend.

18. A three dot fiber optic sighting system for firearms, comprising:

(a) a rear sight block for mounting on the rear portion of a firearm barrel and having an upper surface with a central channel and having passages therein on opposite sides of and adjacent said channel in said block, said channel and passages all extending longitudinally thereof, said rear sight block being formed of an optically clear material, said rear sight block having scintillating fibers in said passages with their proximal ends visible to a shooter, said rear sight block having an opaque rear surface about said fibers which is provided by an opaque cap secured to the rear surface of said block, said cap having passages therein aligned with the adjacent ends of said passages in said rear sight block and into which said scintillating fibers extend, said rear sight cap being made of an opaque resin and the axes of said rear sight block cap passages being parallel to the barrel of the firearm, said passages in said rear sight block being angled downwardly from the juncture of said cap and said block; and (b) a front sight block for mounting on the front portion of a firearm barrel, said front sight block having at least one upstanding post for alignment with said rear sight block channel between said rear sight scintillating fibers, said post being formed of an optically clear polycarbonate resin and having a passage therein in which is disposed a scintillating fiber having a proximal end visible to the shooter, whereby the three fibers may be aligned.

19. The three dot fiber optic sighting system for firearms in accordance with claim 18 wherein said scintillating fibers have a polystyrene core doped with a fluorescent dopant and a polymethyl methacrylate cladding.

20. A three dot fiber optic sighting system for firearms, comprising:

(a) an elongated rear sight block for mounting on the rear portion of a firearm barrel and having an upper surface with a central channel and having elongated passages therein on opposite sides of and adjacent said channel, said channel and passages all extending longitudinally thereof, the upper surface of said rear sight block sloping downwardly from its proximal end, said rear sight block being formed of an optically clear material, said rear sight block having elongated scintillating fibers extending in said passages with their proximal ends visible at said rear surface to a shooter, said scintillating fibers being elongated and reacting to light impinging thereon and passing through said optically clear material of said rear sight block; and (b) a front sight block for mounting on the front portion of a firearm barrel, said front sight block having at least one upstanding post for alignment with said rear sight block channel between said rear sight scintillating fibers, said post being formed of an optically clear material and having a passage therein in which is disposed an elongated scintillating fiber having a proximal end visible to the shooter, whereby the three fibers may be aligned to align the firearm with a target.

* * * * *

UNITED STATES PATENT AND TRADEMARK OFFICE

CERTIFICATE OF CORRECTION

PATENT NO. : 6,035,539

DATED : March 14, 2000

INVENTOR(S) : Ned J. Hollenbach, Randall D. Jerrigan, Dean N. Williams

It is certified that error appears in the above-identified patent and that said Letters Patent is hereby corrected as shown below:

Column 6, line 38, "rear support sight" should be--rear sight support--.

Column 7, line 26, after "sight" insert --block--.

Signed and Sealed this

Sixth Day of February, 2001

*Attest:*

*Attesting Officer*

Q. TODD DICKINSON

*Director of Patents and Trademarks*